US008774418B2

(12) United States Patent
Chang et al.

(10) Patent No.: US 8,774,418 B2
(45) Date of Patent: Jul. 8, 2014

(54) MULTI-CHANNEL DOWN-MIXING DEVICE

(75) Inventors: Pao-Chi Chang, Taoyuan County (TW); Tai-Ming Chang, Pingtung County (TW); Yi-Ming Shiu, Taoyuan County (TW)

(73) Assignee: National Central University, Jhongli, Taoyuan County (TW)

( * ) Notice: Subject to any disclaimer, the term of this patent is extended or adjusted under 35 U.S.C. 154(b) by 384 days.

(21) Appl. No.: 13/417,157

(22) Filed: Mar. 9, 2012

(65) Prior Publication Data

US 2013/0182853 A1 Jul. 18, 2013

(30) Foreign Application Priority Data

Jan. 12, 2012 (TW) ..... 101101210 A

(51) Int. Cl.
*H04R 5/00* (2006.01)

(52) U.S. Cl.
USPC ..... 381/18; 381/17

(58) Field of Classification Search
USPC ..... 381/1, 17–22, 27, 61–63, 71.11, 119, 381/306, 307; 700/94
See application file for complete search history.

(56) References Cited

U.S. PATENT DOCUMENTS

2008/0049948 A1* 2/2008 Christoph et al. ..... 381/86
2011/0243338 A1* 10/2011 Brown ..... 381/17
2012/0170757 A1* 7/2012 Kraemer et al. ..... 381/17

* cited by examiner

*Primary Examiner* — Vivian Chin
*Assistant Examiner* — Friedrich W Fahnert
(74) *Attorney, Agent, or Firm* — Jackson IPG PLLC

(57) ABSTRACT

A down-mixing device is provided. 5.1-channel sounds are down-mixed into 4-channel sounds with high-quality multi-channel surrounding sound effect reappeared. A common-acoustic-pole and zero (CAPZ) model is used to rebuild frequency responses of original head-related transfer functions (HRTF). Direct sounds, reflection sounds and late reverberation in a spatial sound field are gathered. Thus, varieties of sounds become rich and 3-dimensional hearing experiences are enhanced with low cost for a 4-channel earphones system.

8 Claims, 3 Drawing Sheets

MULTI-CHANNEL DOWN-MIXING DEVICE

TECHNICAL FIELD OF THE INVENTION

The present invention relates to down-mixing; more particularly, relates to realizing 5.1-channel cinema sound-field effect with 4-channel earphones, where a common-acoustic-pole and zero (CAPZ) model is used in a down-mixing device to transform all-zero head-related transfer functions (HRTF) into infinite impulse response (IIR) filter for rebuilding multi-channel sound field.

DESCRIPTION OF THE RELATED ARTS

In general, audio signals outputted from earphones are formed into sounds directly entered into ear canals to generate a sound field in the brain. But, this kind of audio signals does not have some sound field information in an actual space for clearly representing effects of moving sound sources. Hence, enhanced stereo earphones are provided, where 2-channel earphones are added with HRTF for corresponding to locations of 2-channel loudspeakers in the actual space. However, following developments in technologies, 5.1-channel sound systems are basic in structures of from home theaters to grand theaters. For simulating locations of virtual loudspeakers with the HRTF, prior arts have to pay some amount of money on hardware, while, with the increase in number of the loudspeakers, the money paid on hardware is multiplied to result in cost expanded. Hence, the prior arts do not fulfill all users' requests on actual use.

SUMMARY OF THE INVENTION

The main purpose of the present invention is to realize 5.1-channel cinema sound-field effect with 4-channel earphones, where a CAPZ model is used in a down-mixing device to transform all-zero HRTF into IIR filter for rebuilding multi-channel sound field.

The second purpose of present invention is to provide only a set of common-pole coefficients and a plurality of zero coefficients of a corresponding angle to perfectly rebuild frequency responses of original HRTF for not only greatly reducing cost in hardware realization but also greatly enhancing real-time system processing speed on realizing high-quality multi-channel surrounding sound effect, where richness in varieties of audio signals is improved and more abundant 3-dimensional hearing experiences are provided in a earphones system.

The third purpose of the present invention is to realize 5.1-channel cinema sound-field with 4-channel earphones, where actual multi-channel surrounding sound field is effectively rebuilt with a 4-channel earphones system with low cost and high hearing experiences.

To achieve the above purposes, the present invention is a multi-channel down-mixing device, comprising a HRTF module, a CAPZ model, an artificial reverberator, a down-mixing module, a channel distributor and a 4-channel player, where the HRTF module provides HRTF to transform a single audio signal into singles heard by two ears of a human to obtain sound source locations of virtual loudspeakers in a space; the CAPZ model is connected with the HRTF module to transform the HRTF into a model having common-poles and zeros and the model has a plurality of zero coefficients at every angle and has a set of common-pole coefficients; the artificial reverberator simulates a plurality of reflection echoes of audio waves in the space with user-provided information of the space to obtain a set of reverberation coefficients; the down-mixing module is connected with the CAPZ model and the artificial reverberator to use the plurality of zero coefficients of all angles and the set of common-pole coefficients to down-mix 5.1-channel audio signals into 4-channel audio signals with coordination of the reverberation coefficients; the channel distributor is a sound-effect card having more than 2-channels and is connected with the down-mixing module to output the 4-channel audio signals obtained from the down-mixing module; and the 4-channel player is connected with the channel distributor to output sounds obtained by converting the 4-channel audio signals. Accordingly, a novel multi-channel down-mixing device is obtained.

BRIEF DESCRIPTIONS OF THE DRAWINGS

The present invention will be better understood from the following detailed description of the preferred embodiment according to the present invention, taken in conjunction with the accompanying drawings, in which FIG. 1 is the structural view showing the preferred embodiment according to the present invention;

DESCRIPTION OF THE PREFERRED EMBODIMENT

The following description of the preferred embodiment is provided to understand the features and the structures of the present invention.

Figure 1:
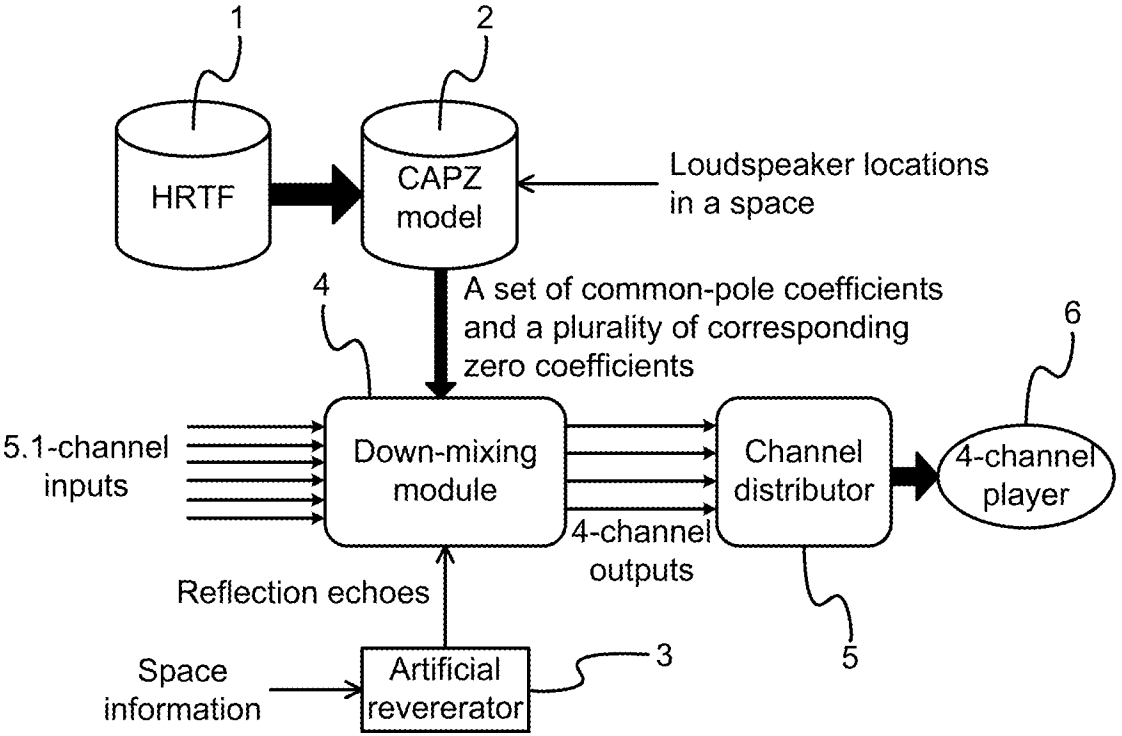
Figure 2:
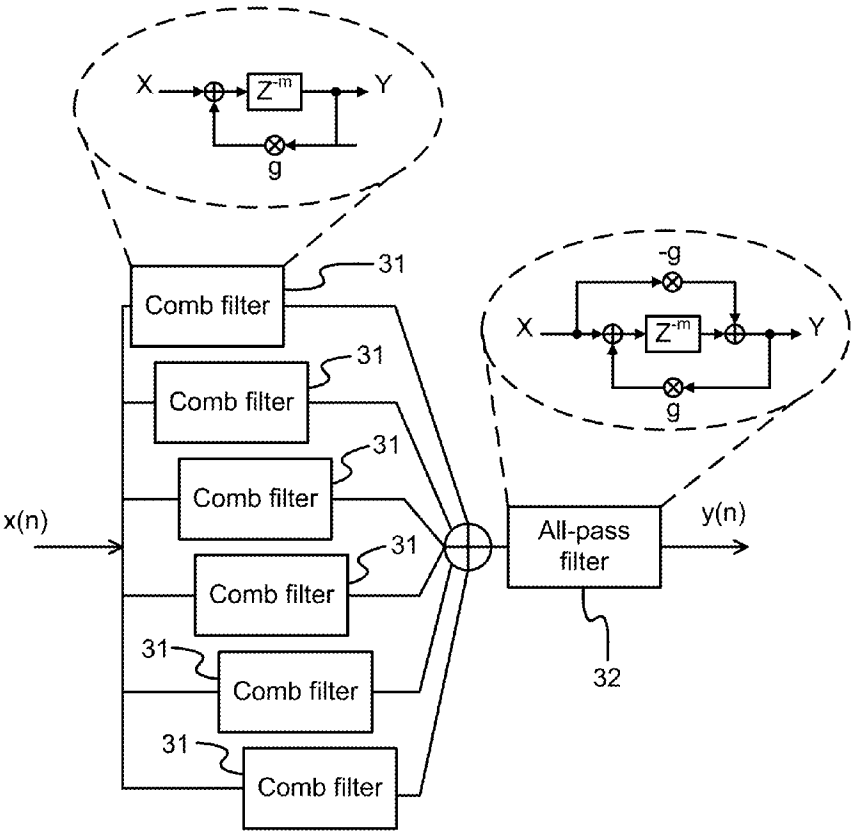
FIG. 2 is the structural view showing the artificial reverberator.
Figure 3:
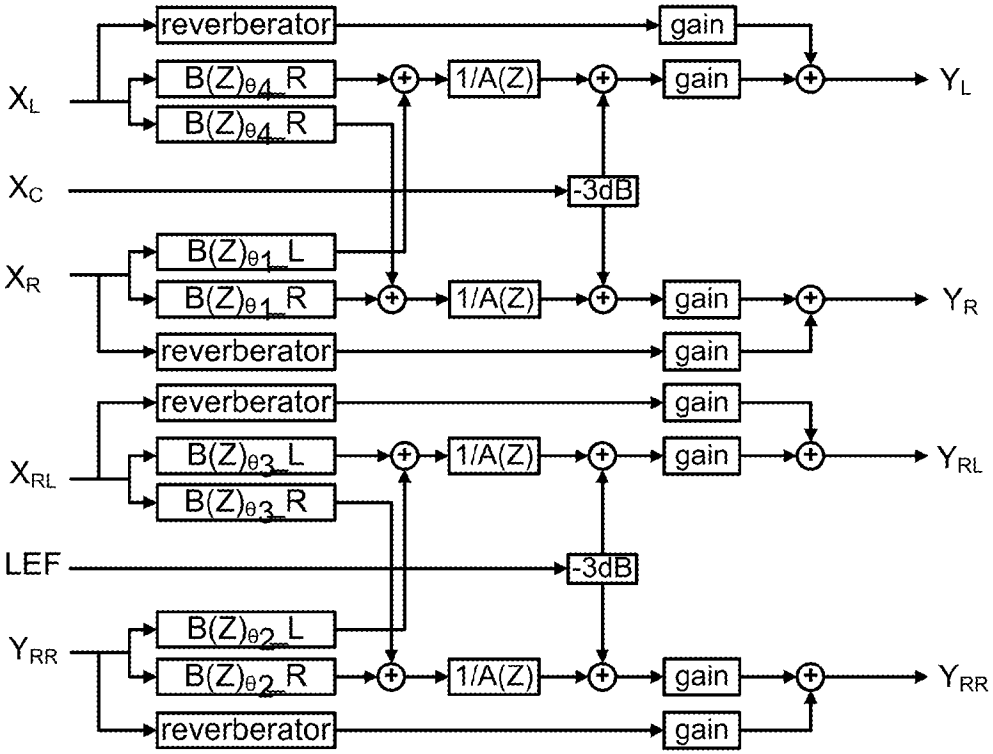
FIG. 3 is the structural view showing the down-mixing module.

Please refer to FIG. 1 to FIG. 3, which are structural views showing a preferred embodiment, an artificial reverberator and a down-mixing module according to the present invention. As shown in the figures, the present invention is a multi-channel down-mixing device, where a device is provided to down-mix 5.1-channel sounds into 4-channel sounds for rebuilding surrounding sound effect. The present invention comprises a head-related transfer functions (HRTF) module 1, a common-acoustic-pole and zero (CAPZ) model 2, an artificial reverberator 3, a down-mixing module 4, a channel distributor 5 and a 4-channel player 6, where an actual multi-channel surrounding sound field is rebuilt with a 4-channel earphones system with low cost yet high quality sound performance.

The HRTF module 1 provides HRTF to transform a single audio signal into signals heard by two human ears to generate sound source locations of virtual loudspeakers in a space.

The CAPZ model 2 is connected with the HRTF module 1. At first, the CAPZ model 2 transforms the HRTF into a model having common-poles and zeros, where the model has a plurality of corresponding zero coefficients for each angle and has a set of common-pole coefficients for all angles. Then, the CAPZ model 2 transfers the set of common-pole coefficients and pluralities of corresponding zero coefficients for angles of the virtual loudspeakers in the space to the down-mixing module 4 for synthesizing multi-channel audio signals.

For a spatial sound field, there are direct sounds, reflection sounds and late reverberation to enrich sounds in the space. The artificial reverberator 3 generates a plurality of reflection echoes of audio waves in the space with user-provided information of the space. Through simulating delayed signals of the audio waves reflected by six walls of the space and reverberating times of the delayed signals in the space, a set of reverberation coefficients is obtained for rebuilding spatial sound field effect and the set of reverberation coefficients is transferred to the down-mixing module 4 for synthesizing reverberation signals. Therein, the information of the space comprises a length, a width and a height of the space and an average absorption coefficient of material of the space.

The down-mixing module 4 is connected with the CAPZ model 2 and the artificial reverberator 3. The down-mixing module 4 uses the pluralities of zero coefficients and the set of common-pole coefficients, both of which coefficients are obtained from the CAPZ model 2, to down-mix 5.1-channel audio signals into 4-channel audio signals. According to locations of loudspeakers in the space, the 5.1-channel audio signals are added with HRTF to be down-mixed into the 4-channel audio signals for enhancing sound location effect with coordination of the reverberation coefficients generated by the artificial reverberator 3.

The channel distributor 5 is connected with the down-mixing module 4. The channel distributor 5 is at least one sound card having more than 2-channels for outputting the 4-channel audio signals obtained from the down-mixing module 4. Therein, the channel distributor 5 is a set of two sound cards outputting stereo sound or a sound card outputting 4-channel audio signals.

The 4-channel player 6 is connected with the channel distributor 5 to output sounds obtained by converting the 4-channel audio signals, where the 4-channel player 6 is a pair of earphones having 4-channel outputs and each of the earphones has 2-channel outputs.

The present invention uses the CAPZ model 2 to rebuild the HRTF, where the HRTF for each angle θ can be replaced with CAPZ model by using the following equation:

$$H(\theta, z) = \frac{B(\theta, z)}{A(z)} = \frac{\sum_{i=0}^{Q} b_i(\theta) z^{-1}}{1 - \sum_{i=0}^{P} a_i z^{-1}}.$$

Therein, θ is the corresponding angle of the HRTF, P is the number of poles; and Q is the number of zeros.

The zeros for the corresponding angle and the common poles are figured out with the following equation:

$$x = (A^T A)^{-1} A^T h_a$$

Therein, x contains the final estimated coefficients of common poles and zeros figured out with the following equations:

$$x = [a^T, b^T(\theta_1), b^T(\theta_2), \ldots, b^T(\theta_M)]^T$$

$$a = [a_1, a_2, \ldots, a_P]^T$$

$$b(\theta_m) = [b_0(\theta_m), b_1(\theta_m), \ldots, b_Q(\theta_m)]^T$$

$$h_a = [h^T(\theta_1), h^T(\theta_2), \ldots, h^T(\theta_M)]^T$$

$$h(\theta_m) = [h_0(\theta_m), h_1(\theta_m), \ldots, h_{N-1}(\theta_m), 0, \ldots, 0]^T$$

$$A = \begin{bmatrix} H(\theta_1) & D & 0 & \ldots & 0 \\ H(\theta_2) & 0 & D & \ddots & \vdots \\ \vdots & \vdots & \vdots & & 0 \\ H(\theta_M) & 0 & 0 & \ldots & D \end{bmatrix}$$

-continued $$H(\theta_m) = \begin{bmatrix} 0 & 0 & \ldots & 0 \\ h_0(\theta_m) & 0 & \ldots & 0 \\ h_1(\theta_m) & h_0(\theta_m) & \ddots & 0 \\ \vdots & \vdots & & \vdots \\ h_{P-1}(\theta_m) & h_{P-2}(\theta_m) & \ldots & h_0(\theta_m) \\ \vdots & \vdots & \ddots & \vdots \\ h_{N-2}(\theta_m) & h_{N-2}(\theta_m) & \ldots & h_{N-P}(\theta_m) \\ 0 & h_{N-1}(\theta_m) & \ddots & h_{N-P-1}(\theta_m) \\ \vdots & \vdots & & \vdots \\ 0 & 0 & \ldots & h_{N-1}(\theta_m) \end{bmatrix}$$

$$D = \begin{bmatrix} 1 & \ldots & 0 \\ \vdots & \ddots & \vdots \\ 0 & \ldots & 1 \\ 0 & \ldots & 0 \\ \vdots & \ddots & \vdots \\ 0 & \ldots & 0 \end{bmatrix}$$

The artificial reverberator 3, as shown in FIG. 2, can be a Moorer's reverberator, comprising a plurality of comb filters 31 and an all-pass filter 32, which uses the following equations:

$$H(z) = \frac{z^{-m}}{1 - g \cdot z^{-m}} \quad \text{(comb filter)}$$

$$H(z) = \frac{z^{-m} - g}{1 - g \cdot z^{-m}} \quad \text{(all-pass filter)}$$

The six comb filters 31 are the delayed times of sound waves on reaching hearer's ears after reflected by the six walls of the space. Then, the delayed signals are summed up to be passed through the all-pass filter 32 for enhancing reverberating effect. The reverberating times in the space are figured out with the following equation:

$$Revb_{time} = \frac{60 \cdot E}{0.085 \cdot C \cdot \text{total_absor}}.$$

Therein, E is a volume of the space; C is the sound speed; and total_absor is an average absorption coefficient for each wall in the space.

The down-mixing module 4, as shown in FIG. 3, uses a down-mixing algorithm to transform 5.1-channel audio signals into 4-channel audio signals with the following equations:

$$\begin{cases} Y_L = \alpha\left(\left(X_L * B(z)_{\theta_{4_l}} + X_R * B(z)_{\theta_{1_l}}\right) * \frac{1}{A(z)} + 0.707 \cdot X_c\right) + \beta(X_L * Revb) \\ Y_R = \alpha\left(\left(X_R * B(z)_{\theta_{1_r}} + X_L * B(z)_{\theta_{4_r}}\right) * \frac{1}{A(z)} + 0.707 \cdot X_c\right) + \beta(X_R * Revb) \\ Y_{RL} = \alpha\left(\left(X_{RL} * B(z)_{\theta_{3_l}} + X_{RR} * B(z)_{\theta_{2_l}}\right) * \frac{1}{A(z)} + 0.707 \cdot X_{LEF}\right) + \beta(X_{RL} * Revb) \\ Y_{RR} = \alpha\left(\left(X_{RR} * B(z)_{\theta_{2_r}} + X_{RL} * B(z)_{\theta_{3_r}}\right) * \frac{1}{A(z)} + 0.707 \cdot X_{LEF}\right) + \beta(X_{RR} * Revb) \end{cases}$$

Therein, Y is an output signal obtained after synthesis with a subscript of corresponding channel (L: left, R: right, RL: rear left and RR: rear right); X is an input signal with a subscript for a corresponding channel (L: left, R: right, C: center, RL: rear left, RR: rear right and LEF: low frequency effect); * is a convolution integral sign; · is a multiplication sign; Revb is an artificial reverberator; B(z) are the zero coefficients of the CAPZ model at the corresponding angle; A(z) are the common-pole coefficients of the CAPZ model; and $\alpha$ and $\beta$ are controllable gains.

The present invention reveals a down-mixing device for rebuilding multi-channel sound field, where 5.1-channel surrounding sound effect is rebuilt for 4-channel earphones. A 5.1-channel cinema sound-field effect is realized with 4-channel earphones, where a CAPZ model is used to re-design HRTF for transforming all-zero HRTF into infinite impulse response (IIR) filter. The HRTF for each angle only uses a set of common-pole coefficients for all angle and a plurality of corresponding zero coefficients for the angle to generate sound source locating effect for perfectly rebuilding frequency responses of original HRTF. Not only hardware cost is greatly reduced, but also sound field effect of multi-reflected sound waves of multi-channel audio signals in a space is realized by an artificial reverberator. Furthermore, not only real-time processing speed is greatly enhanced, but also high-quality multi-channel surrounding sound effect is reappeared simultaneously. Thus, richness in varieties of audio signals is improved and more abundant 3-dimensional hearing experiences are provided by an earphones system.

To sum up, the present invention is a multi-channel down-mixing device, where hardware cost is greatly reduced; time processing speed is greatly enhanced; high-quality multi-channel surrounding sound effect is reappeared; richness in varieties of audio signals is improved; and more abundant 3-dimensional hearing experiences are provided by an earphones system.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A multi-channel down-mixing device, comprising a head-related transfer functions (HRTF) module, said HRTF module providing HRTF to transform a single audio signal into signals heard by two human ears to obtain sound source locations of virtual loudspeakers in a space;

a common-acoustic-pole and zero (CAPZ) model, said CAPZ model being connected with said HRTF module, said CAPZ model transforming said HRTF into a model having common-poles and zeros, said model having a plurality of corresponding zero coefficients for each angle and a set of common-pole coefficients for all angles;

an artificial reverberator, said artificial reverberator obtaining a plurality of reflection echoes of audio waves in said space with user-provided information of said space to obtain a set of reverberation coefficients;

a down-mixing module, said down-mixing module being connected with said CAPZ model and said artificial reverberator, said down-mixing module obtaining said plurality of zero coefficients and said set of common-pole coefficients to down-mix 5.1-channel audio signals into 4-channel audio signals with coordination of said reverberation coefficients;

a channel distributor, said channel distributor being connected with said down-mixing module, said channel distributor being at least one sound card having more than 2-channels to output said 4-channel audio signals obtained from said down-mixing module; and a 4-channel player, said 4-channel player being connected with said channel distributor, said 4-channel player outputting sounds obtained by converting said 4-channel audio signals.

2. The device according to claim 1, wherein said CAPZ model obtains said plurality of zero coefficients for at-least one angle according to at least one audio source of loudspeaker positioned in said space; and wherein said CAPZ model transfers said set of common-pole coefficients and a plurality of corresponding zero coefficients for said at-least one angle to said down-mixing module to obtain multi-channel audio signals.

3. The device according to claim 1, wherein said artificial reverberator simulates delayed signals of said audio waves reflected by six walls of said space and reverberating times of said delayed signals in said space; and wherein said artificial reverberator transfers said reverberation coefficients of said delayed signals and said delay times of said delayed signals to said down-mixing module to synthesize reverberation signals to obtain spatial sound field effect.

4. The device according to claim 1, wherein said artificial reverberator comprises a plurality of comb filters and an all-pass filter.

5. The device according to claim 1, wherein said information of said space comprises a length, a width and a height of said space and an average absorption coefficient of material of said space.

6. The device according to claim 1, wherein said down-mixing module adds said 5.1-channel audio signals with HRTF to obtain sound position effect and down-mixes said 5.1-channel audio signals into said 4-channel audio signals with coordination of said reverberation coefficients of said artificial reverberator.

7. The device according to claim 1, wherein said channel distributor is selected from a group consisting of a set of two sound cards outputting stereo sound and a sound card outputting 4-channel audio signals.

8. The device according to claim 1, wherein said 4-channel player is a pair of earphones having 4-channel outputs and each of said earphones has 2-channel outputs.

* * * * *